United States Patent [19]

Brenteson

[11] Patent Number: 4,601,399

[45] Date of Patent: Jul. 22, 1986

[54] TREE STAND SUPPORT AND DISPLAY APPARATUS

[76] Inventor: Donald I. Brenteson, 811 W. Warner Rd., Tempe, Ariz. 85284

[21] Appl. No.: 656,476

[22] Filed: Oct. 1, 1984

[51] Int. Cl.[4] ..... A47F 7/00

[52] U.S. Cl. ..... 211/60.1; 206/423; 248/523

[58] Field of Search ..... 248/523, 512, 511, 519; 211/60.1, 189; 206/423; 47/46

[56] References Cited

U.S. PATENT DOCUMENTS

| | | | |
|---|---|---|---|
| 1,404,777 | 1/1922 | Leutner | 248/512 |
| 2,191,075 | 2/1940 | Hogan | 248/512 |
| 3,142,464 | 7/1964 | Zelenitz | 248/523 |
| 3,325,127 | 6/1967 | Doskocil | 248/511 |
| 3,966,151 | 6/1976 | Hawkins | 248/523 |

*Primary Examiner*—Ramon O. Ramirez

*Attorney, Agent, or Firm*—Cahill, Sutton & Thomas

[57] ABSTRACT

A device for engaging and holding tree stands in a predetermined display arrangement. A plurality of tree stands having means for supporting the trunk of a tree, such as a Christmas tree, include legs that extend outwardly from the center thereof. An elongated base member is provided with a plurality of sockets positioned along the base member in a predetermined pattern. Each of the sockets is adapted to receive a leg of a corresponding one of the tree stands such that the tree stands, and trees mounted thereon, are maintained in a predetermined display pattern and are supported in a manner to withstand strong winds that would otherwise cause the individual trees and corresponding tree stands to fall.

5 Claims, 6 Drawing Figures

TREE STAND SUPPORT AND DISPLAY APPARATUS

FIELD OF THE INVENTION

The present invention relates to tree support devices, and more particularly, to a tree stand support and display apparatus for maintaining a tree display, such as a Christmas tree display, in a predetermined pattern while supporting the trees and stands against the effects of strong winds.

DESCRIPTION OF THE PRIOR ART

A substantial number of cut Christmas trees are displayed and sold each year. Typically, the trees are supported in an upright fashion so that they may be viewed by prospective purchasers. It has been found advantageous to mount the individual trees on stands so that the trees can more advantageously be displayed and possibly create a sale for the stand along with the tree. Such tree stands have taken many forms but typically include a clamp or stake that is fastened to the trunk of the tree and which incorporates a plurality of legs radiating from the center of the stand. These legs, typically three positioned 120° apart, maintain the tree in an upright position and permit the trees to be positioned in an attractive display pattern to attract prospective customers. Frequently, such stands will incorporate water pans to enable the tree retailer, and possibly the prospective customer, to add water to retard the deterioration of the tree.

The stands are typically designed to support the tree when they have ultimately been positioned in a purchaser's home; although the stands will maintain the tree in an upright position in moderate wind conditions, gusty winds or winds only slightly above normal will frequently cause the trees, and stands connected thereto, to fall over. Since the stands have three legs, it is a common sight to see operators of retail Christmas tree outlets rotating the respective trees so that the stands are oriented in a direction to provide maximum support to the tree; that is, they are typically positioned such that one of the three legs is positioned downwind of the tree trunk. Nevertheless, slight wind direction changes can cause the trees, and stands, to fall over.

OBJECTS OF THE INVENTION

It is therefore an object of the present invention to provide a stand support for attachment to tree stands to maintain the stands, and trees supported thereby, in a predetermined display pattern.

It is another object of the present invention to provide a tree stand support device for easy attachment to tree stands to support the stands, and trees mounted thereon, against winds that might otherwise cause the trees to fall.

It is still another object of the present invention to provide a tree stand support and display device that is economical to construct and may be easily installed or stored for the next season.

These and other objects of the present invention will become apparent to those skilled in the art as the description thereof proceeds.

SUMMARY OF THE INVENTION

Briefly, in accordance with the embodiments chosen for illustration, the present invention utilizes a base member formed of an elongated flat steel strip having a plurality of sockets secured thereto, as by welding, positioned there along at predetermined intervals. The sockets may be formed with a cross-section approximating the cross-section of the legs of tree stands which are to be supported thereby. The elongated base member may lie along a straight line or may be formed into a pattern, such as a circle,; further, the sockets may be formed by attaching, such as welding, formed metal strips, or by providing flanges extending from the base member having openings therein that are aligned to receive the legs of the stands.

BRIEF DESCRIPTION OF THE DRAWINGS

The present invention may more readily be described by reference to the accompanying drawings in which.

DETAILED DESCRIPTION OF THE PREFERRED EMBODIMENT

Figure 1:
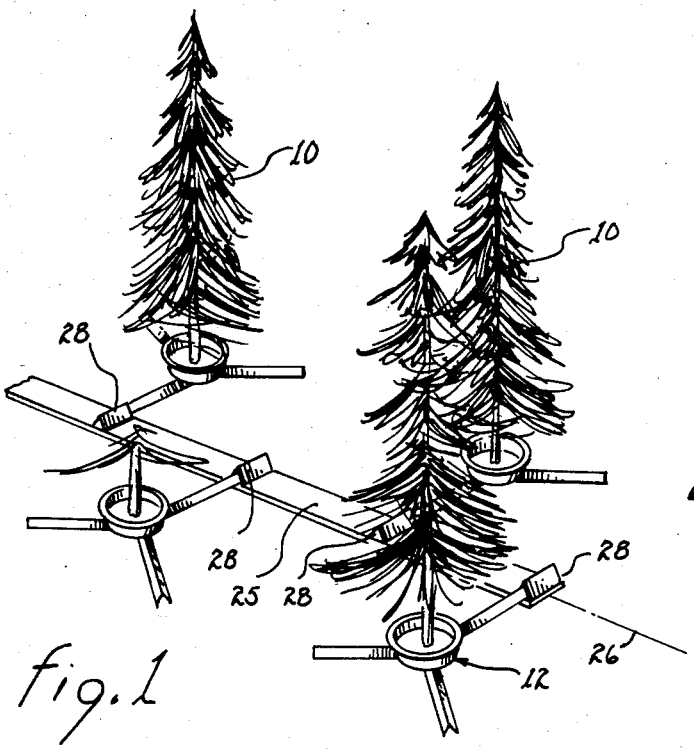
FIG. 1 is a perspective view of a tree stand support and display system constructed in accordance with the teachings of the present invention.
Figure 3:
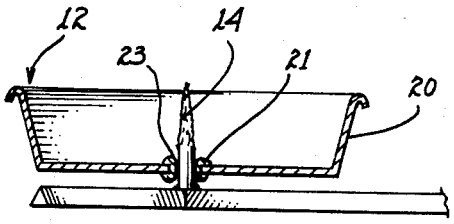
FIG. 3 is a cross-section of a portion of FIG. 2 taken along line 3—3.
Figure 2:
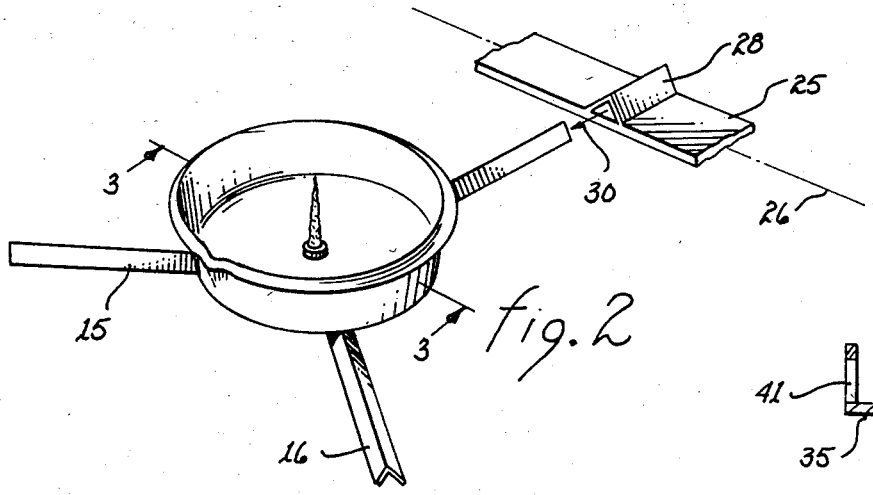
FIG. 2 is an enlarged view of a portion of FIG. 2 showing the arrangement of the sockets with respect to the legs of the tree stands.

Referring now to FIGS. 1, 2 and 3, a tree stand support and display apparatus constructed in accordance with the teachings of the present invention is shown. A plurality of trees 10 such as Christmas trees are each individually supported by tree stands 12. The stands may include a clamping means or alternatively a spike or stake 14 that is set into the base of the tree trunk. The stake is supported, such as by welding, to legs 15, 16 and 17 extending radially therefrom and spaced 120° apart. It may be noted that the legs 15, 16 and 17 are generally horizontal; however, it may be found to be advantageous for the legs to slope gently downwardly as they extend from the center of the stand at the stake 14.

A water pan 20 having an opening 21 therein may be positioned on the stake 14 and provided with a rubber bushing 23 to sealingly engage the stake 14 to permit the pan to receive and retain water about the base of the trunk of the tree being supported by the stand. An elongated base member 25 extending on axis 26 parallel to the ground is positioned in contact with the ground and incorporates a plurality of sockets 28 positioned there along at predetermined spaced intervals.

Each of the sockets 28 is formed with a cross-section substantially conforming to the cross-section of the legs 15, 16 and 17. In the embodiment chosen for illustration, the legs incorporate a triangular cross-section; therefore, the sockets 28 also have a triangular cross-section. In some instances, it may not be necessary for the socket cross-section to precisely conform to the cross-section of the leg. For example, some embodiments may incorporate legs 15, 16 and 17 made out of circular cross-section steel bars which could nevertheless be inserted into the sockets 28 even though the latter may have a triangular cross-section. However, it is preferred that the cross-sectional shape of the sockets conform to the cross-sectional shape of the individual legs. As most clearly shown in FIG. 2, the legs, such as leg 17, is slipped into the socket 28 along an axis of entry 30 of the socket 28. In the preferred embodiment, the axis of entry 30 is perpendicular to the longitudinal axis 26 of the base member 25. In some instances, the perpendicular relationship of the two axis may be altered to provide a desired display pattern.

Figure 6:
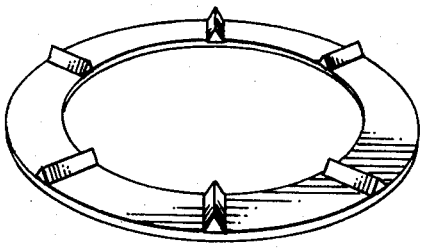
FIG. 6 is an alternative embodiment for the form of the base member portion of the present invention.

In the embodiment shown in FIG. 1, the base member 25 is shown extending along a straight line; however, other display patterns may be created by forming the base member into shapes other than a straight line. For example, FIG. 6 is an illustration indicating the utilization of a base member that is formed into a circle. Since the base member is usually constructed of metal, and since edge forming a metal strip as shown in FIG. 6 may be difficult, the circular format shown in FIG. 6 may be approximated by segmenting short lengths of metal to form a polygon to approximate the circular configuration.

Figure 5:
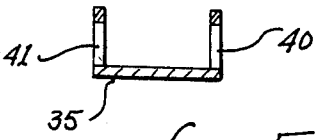
FIG. 5 is a cross-section of FIG. 4 taken along line 5—5.
Figure 4:
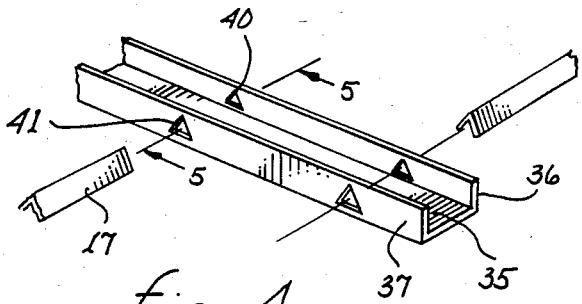
FIG. 4 is a perspective view of an alternative form of the base member of the present invention.

Referring now to FIGS. 4 and 5, an alternative embodiment is shown incorporating a base member 35 having a pair of flanges 36 and 37 extending upwardly therefrom. The flanges and base member may be formed from a single sheet of metal into the shape shown in FIG. 4. In the embodiment shown in FIGS. 4 and 5, the sockets are formed by openings such as those shown at 40 and 41 provided in flanges 36 and 37 respectively. The openings 40 and 41 are aligned and are provided with a cross-sectional shape generally conforming to the cross-sectional shape of the tree stand leg 17. The openings 40 and 41 thus form a socket to receive and support tree stands coupled to the base member through the insertion of their respective legs in the sockets provided in the base member.

In the embodiments shown in FIGS. 1 and 4, it may be seen that the respective tree stands are inserted into the sockets from alternate sides of the base member 25 or 35. Depending on the configuration used in forming the base member, and the display pattern desired, the tree stands may be supported by the base member on one side or in a pattern on both sides.

The tree stand support and display apparatus of the present invention thereby permits the display of trees mounted in respective tree stands in a predetermined and attractive manner. Further, the "locking" of the tree stands to the base member provides resistance to wind and wind gusts that may otherwise cause the trees and stands to fall. It is also important to note that the respective components of the apparatus may be disassembled and conveniently stored in a minimum of space; this latter feature is particularly important in the Christmas tree industry since the season, during which the apparatus of the present invention will be used, is relatively short and the period of storage for the equipment is long.

I claim:

1. A tree stand support and display apparatus comprising:

a. a plurality of tree stands each adapted to be secured to the trunk of a tree to be displayed, and each including a plurality of legs extending therefrom;

b. an elongated base member having a flat horizontal surface parallel to the ground and a plurality of sockets positioned along said base member, said base member contacting and being supported by the ground and having an axis extending parallel thereto;

c. each of said sockets receiving a leg on a corresponding one of said stands.

2. The combination set forth in claim 1 wherein each of said sockets includes a cross-section conforming to a cross-section of a leg of one of said stands.

3. The combination set forth in claim 2 wherein each of said sockets includes a triangular cross-section.

4. The combination set forth in claim 1 including a plurality of sockets secured to an upper surface thereof spaced along said surface at predetermined intervals, each of said sockets having an axis of entry extending substantially perpendicularly with respect to the axis of said base member.

5. The combination set forth in claim 1 wherein said base member includes a pair of spaced apart flanges extending upwardly from said horizontal surface, said pair of spaced apart flanges including means defining openings therein, the openings in one flange aligned with the openings in the other flange to form sockets to receive the legs of said stands.

* * * * *